US006401631B1

(12) United States Patent
Kane et al.

(10) Patent No.: US 6,401,631 B1
(45) Date of Patent: Jun. 11, 2002

(54) FOLDING LEG TABLE CONSTRUCTION

(75) Inventors: Brian Kane; Brian Graham; Mark Kapka, all of San Francisco, CA (US)

(73) Assignee: Falcon Products, Inc., New Port, TN (US)

( * ) Notice: Subject to any disclaimer, the term of this patent is extended or adjusted under 35 U.S.C. 154(b) by 0 days.

(21) Appl. No.: 09/589,989

(22) Filed: Jun. 7, 2000

Related U.S. Application Data

(60) Provisional application No. 60/137,910, filed on Jun. 7, 1999.

(51) Int. Cl.[7] ..... A47B 9/16

(52) U.S. Cl. ..... 108/116; 108/127; 108/147.19; 108/12; 108/19

(58) Field of Search ..... 108/11, 13, 18, 108/19, 115, 121, 127, 128, 132, 155, 159.12, 160, 147.19, 129

(56) References Cited

U.S. PATENT DOCUMENTS

| | | | | |
|---|---|---|---|---|
| 3,557,720 A | | 1/1971 | Blink et al. | |
| 3,585,945 A | * | 6/1971 | Nielsen | 108/132 X |
| 3,799,073 A | | 3/1974 | Nielsen | |
| 3,861,325 A | | 1/1975 | Bue et al. | |
| 4,471,969 A | * | 9/1984 | Zabala et al. | 108/19 X |
| 4,779,542 A | | 10/1988 | Staten et al. | |
| 4,932,333 A | | 6/1990 | Jensen et al. | |
| 5,092,615 A | * | 3/1992 | Gregalis | 108/13 X |
| 5,279,233 A | | 1/1994 | Cox | |
| 5,284,100 A | * | 2/1994 | Thorn | 108/129 |
| 5,615,451 A | | 4/1997 | Peterson et al. | |
| 5,819,671 A | * | 10/1998 | Ocampo | 108/19 X |

FOREIGN PATENT DOCUMENTS

| | | | | |
|---|---|---|---|---|
| DE | 1041643 | * | 10/1958 | 108/19 X |
| GB | 2215191 | * | 9/1989 | 108/129 X |

* cited by examiner

*Primary Examiner*—Peter M. Cuomo
*Assistant Examiner*—Michael J. Fisher
(74) *Attorney, Agent, or Firm*—Polster, Lieder, Woodruff & Lucchesi, LC

(57) ABSTRACT

A folding table is provided with a foldable leg structure. The legs fold between a first working position and a second stored position. As the legs move towards the stored position, a pair of wheels associated with the legs structure are moved into operative position, enabling the table top to be rolled easily to storage.

9 Claims, 2 Drawing Sheets

FOLDING LEG TABLE CONSTRUCTION

CROSS-REFERENCE TO RELATED APPLICATIONS

This application claims priority from Provisional application Ser. No. 60/137,910, filed Jan. 7, 1999.

STATEMENT REGARDING FEDERALLY SPONSORED RESEARCH OR DEVELOPMENT

Not Applicable.

BACKGROUND OF THE INVENTION

This invention relates to folding table structures, and in particular, to a leg structure which operates to move wheels into an operative position in the folded position of the legs, enabling the table to be moved easily.

Folding tables are well known in the art. They commonly are used in homes, offices, training rooms, cafeterias, etc. when extra table space is needed. When not needed, the tables are folded up and stored in some convenient manner.

The prior art reveals a number of structures which are designed to enable a working surface, for example, a table, to be moved from its working position to its stored condition. In general, these structures tend to be complicated, and are designed to be associated with the ground engaging end of the leg structure. The prior art references of which we are aware include U.S. Pat. No. 3,799,073, issued Mar. 26, 1976; U.S. Pat. No. 3,861,325, issued Jan. 21, 1975; U.S. Pat. No. 3,557,720, issued Jan. 26, 1971; U.S. Pat. No. 4,932,333, issued Jun. 12, 1990; U.S. Pat. No. 5,615,451, issued Apr. 1, 1997 and U.S. Pat. No. 4,779,542, issued Oct. 25, 1988 . While each of these prior art references work for their intended purposes, as indicated above, they have approached the mobility problem for folding tables by assuming that the wheels associated with the folding table should be associated with the ground engaging end of the leg structure. We have devised a simple folding table leg structure which mounts the wheels along the underside of an associated tabletop, interconnecting the wheels with the underside in a manner that moves the wheels relatively outwardly from the underside of the table as the leg structure is moved to its folded position. Thereafter, either end of the tabletop can be lifted and wheeled in a manner similar to the operation of wheelbarrow, for example, to a second location. In the stored position of the wheels (i.e., the operative position of the table), the wheels are hidden from normal view. Even if seen, however, the wheels appear to be a part of the leg structure so that they are aesthetically pleasing and yet extremely functional in operational use.

BRIEF SUMMARY OF THE INVENTION

One of the objects of this invention is to provide a folding leg structure which provides wheels for movement of an associated table top.

Another object of this invention is to provide a low cost folding table structure which includes a wheel structure.

Yet another object of this invention is to provide a wheel structure for a tabletop which incorporates the wheels in a manner that is aesthetically pleasing in function and use.

Yet another object of this invention is to provide a fold up table which includes adjustable leg structure.

Other objects of this invention will be apparent to those skilled in the art in view of the following description of the accompanying drawings.

In accordance with this invention, generally stated, a table has at least one leg structure operatively associated with the underside of the table. The leg structure, in turn includes at least one wheel associated with the leg structure. In the preferred embodiment, a pair of wheels is associated with each leg structure. The leg structure includes the wheels themselves, and a link between the leg structure and the underside of the table, permitting the legs to be moved between a first working or table supporting position and a second folded position. Movement of the legs towards the second position operates to move the wheels from a first position near the underside of the table to a position relatively further from the underside. In the preferred embodiment, the legs also are adjustable to provide various table heights.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

Figure 1:
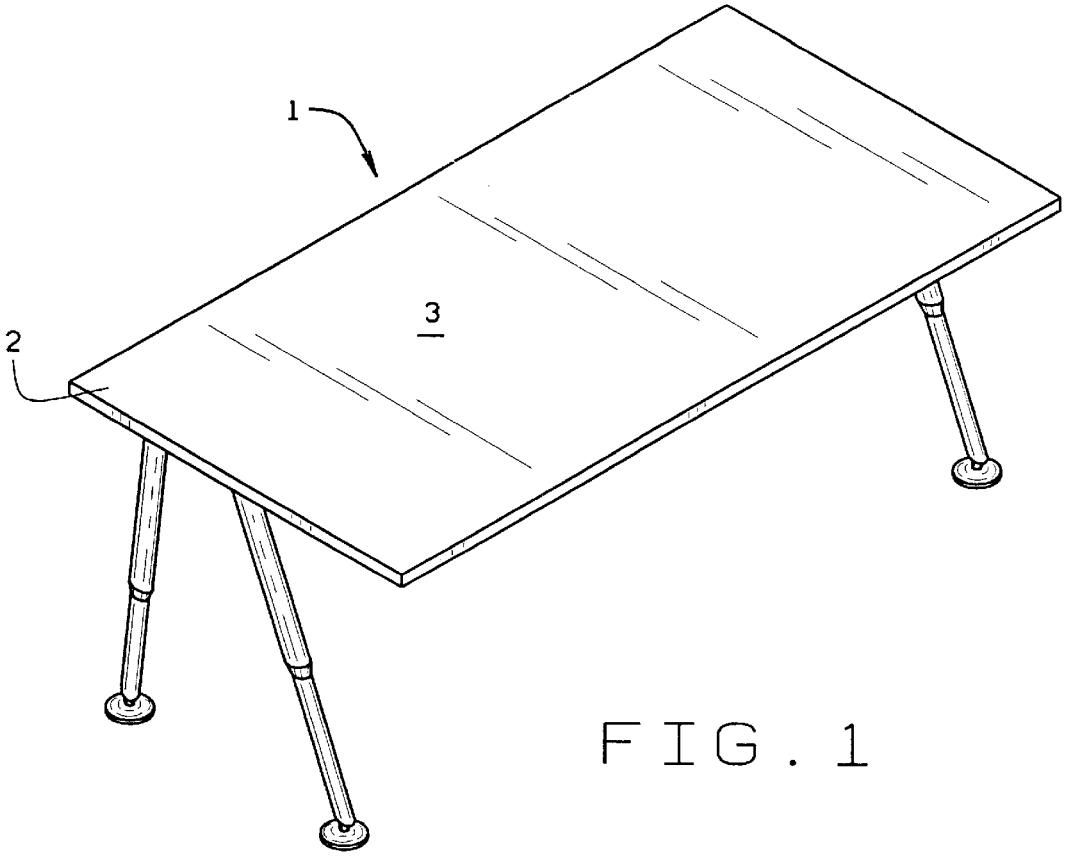
FIG. 1 illustrates an illustrative embodiment of foldable table employing the leg structure of our new design.

Referring now to FIG. 1, reference numeral 1 indicates one illustrative embodiment of foldable table of the present invention. The table 1 includes a top 2, having an upper side 3 and a lower side 4. A pair of beams 5 and 5' extend along the underside 4 of the table in a conventional manner. The embodiment illustrated includes a pair of leg structures 6 and 7 associated with the underside of the table 1, as later described in greater detail. As will be appreciated by those skilled in the art, the top 2 of the table 1 may assume a variety of designs, and any of those designs are compatible with the broader aspects of the present invention.

The leg structures 6 and 7 are identical and for purposes of brevity, only a single leg structure is described in detail. Those skilled in the art also will recognize that our invention may find utility in constructions where only a single leg structure is employed. For example, one end of the table maybe removably mounted to a wall or other supporting structure while the leg structure 6 provides the second support for the table. In any event, leg structure 6 includes an upper tubular structure or tube 10, a first leg section 11, a second leg section 12, a footpad 13, and, in the preferred embodiment, a pair of wheels 14.

The tube 10 is a cylindrical structure adapted to receive and mount the first leg section 11. In the embodiment illustrated, each single tubular structure 10 is adapted to receive and mount two of the upper leg sections 1 1. Attachment between the leg section 11 and the tube 10 may be accomplished in any convenient method.

Figure 3:
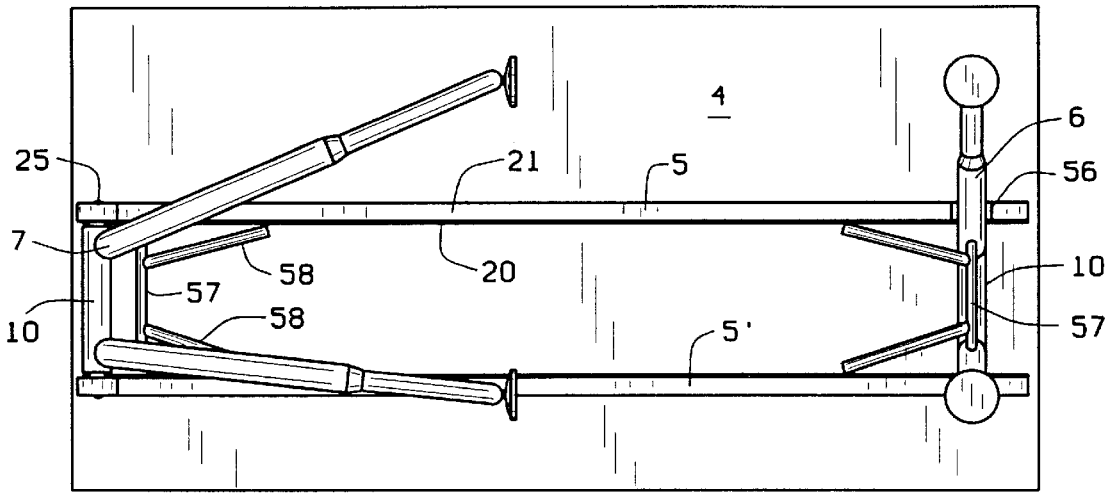
FIG. 3 is a bottom plan view of the table shown in FIG. 2.
Figure 4:
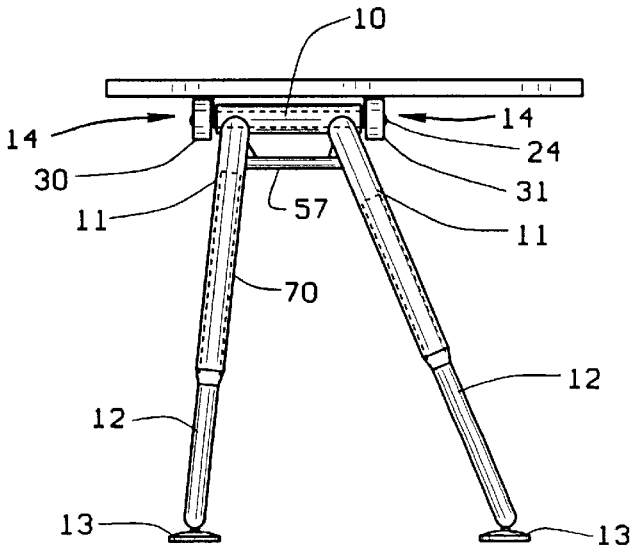
FIG. 4 is a view in side elevation.

Referring now to FIG. 3, it may be observed that each of the beams 5 and 5' is generally L shaped in side elevation, the L being defined by a leg 20 and a leg 21. The leg 21 is positioned so it abuts the lower side 4 of the table 2, and is attached thereto by any convenient method. Epoxy adhesive or conventional threaded fasteners, for example, are used in the art. The tube 10 is sized to be positioned between the legs 20 of each of the beams 5 and 5', as best observed in FIG. 3.

Each tube 10 has at least one axle 25 associated with it, which extends outwardly along each of the opposite ends of the tube 10. While described as a single axle, those skilled in the art will appreciate that in fact the axle may be separated. That is to say, the axle 25 need not be continuous through the tube 10. Rather, a pair of individual axle sections may be mounted along each end of the tube. Axle 25, whether a single and or multiple parts, is used to mount the wheels 30 and 31 of wheel pair 14 along the opposite sides of the tube 10. Also mounted along the axle 10, inboard of the respective wheels, is a link 40. Link 40 may assume a variety of shapes in various embodiments of the invention. Here it is sufficient to note that the link 40 extends between the leg structure, and one of the beams 5 and 5'. Again, in the embodiment illustrated, each end of the tube 10 has a link 40 associated with it. Each of the links 40 is attached to its respective beam 5 or 5'.

Each of the beams 5 and 5' also has a notch or receptacle 56 formed in it, which is sized to receive the axle 25 in the table supporting position of the leg structure, as later described in greater detail.

A support arm 57 extends between each of the leg sections 11. The support arm 57 has a pair of struts 58 associated with it. The struts 58 extend between the arm 57 and respective one of the beams 5 and 5'. The struts 58 are rotationally mounted about an axis 60 associated with the respective beams 5 and 5', an axis 61 associated with the leg sections 11, and a pivot point 62 associated with the link 40.

As indicated above, the leg section 11 and 12 preferably are telescopically mounted one within the other. A series of adjustment openings 70 are provided along one side of the leg section 11. The leg section 12 carries a spring loaded plunger 39 which enables one to move the part 12 with respect to the part 11 along the openings 70 to adjust the height of the table, the plunger 39 extending through the selected opening 70 to maintain the desired table height.

Footpads 13 are conventional and may comprise any of a variety of designs for providing support to the legs.

Figure 2:
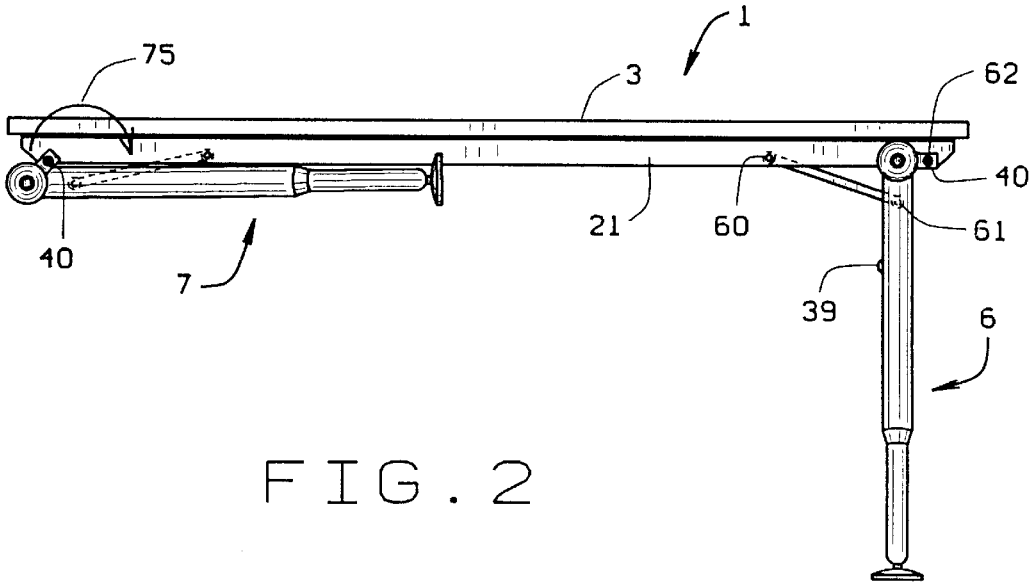
FIG. 2 is a view in side elevation of the table shown in FIG. 1.

Referring now to FIGS. 2 and 3, the extended and stored positions of the leg structure are illustrated. In the extended position of the leg structure, the wheels 30 and 31 are positioned very near the underside of the tabletop 3, and, as is observable in FIG. 1, often invisible to a user of the table. In the extended or operative position of the legs, the axle 25 is received in the notch 56 of the beams 5 and 5' in a conventional manner. Although not shown in the drawings, those skilled in the art will appreciate that a conventional locking mechanism may be employed to retain the axle locked in the notch 56, keeping leg in its table supporting position and preventing inadvertent collapsing of the leg. However, when movement or storage of the table is desired, any latching mechanism, if employed, is released and the leg structure 6 merely is rotated towards the fold up position shown in FIG. 3. As the leg rotates, the link and wheel inscribe a movement arc 75, which permits the leg structure to fold, while simultaneously moving the wheels 30, 31 from their position adjacent the underside of the table 1 to a position relatively outboard with respect to that top. Thereafter, either end of the table merely is lifted, and the table wheeled along the opposite wheel set, in what we have described above as wheelbarrow fashion, to move the table 1 to a new location or to storage, for example.

Numerous variations, within the scope of the appended claims, will be apparent to those skilled in the art in light of the following description of the accompanying drawings. While preferably, the legs are height adjustable, the leg structures may be single height, if desired. As indicated, the particular design of the legs may be altered. We have found it particularly convenient to employ what resembles a "K" design to the legs. This permits or gives a user in certain situations greater access to the length of the table without running above of the associated leg structure. In computer training room situations, for example, associated wire management devices may be employed with the table, if desired. Alternate designs for attaching the strut between the leg structures and the table may be utilized, if desired. These variations are merely illustrative.

Having thus described the invention, what is claimed and desired to be secured by a Letters Patent is:

1. A foldable table comprising:

a tabletop having an upper side and a lower side;

at least one beam mounted to the lower side;

a first leg and a second leg structure, each of said leg structures including a tube, at least one axle mounted to said tube, a pair of legs mounted to said tube, and at least one link mounted between the leg structure and the beam at a pivot point on said beam, at least one wheel mounted to the axle, said legs being movable about said pivot point between a first working position and a second storage position, movement of said legs towards said storage position rotating said wheel from a first position to a second position.

2. The table of claim 1 includes first and second tubular sections, the tubular sections being adjustable with respect to one another.

3. The table of claim 1 further including pads for engaging a support surface for said table in a working position of said legs.

4. The structure of claim 3 further including at least one strut extending between said leg structure and said table.

5. The table of claim 4 wherein said legs are angled with respect to one another.

6. The device of claim 5 wherein one of the legs forms an angle between 30 and 60 degrees with respect to the tube.

7. In a folding table having legs operatively associated with the underside of the table, the improvement comprising at least one wheel associated with said leg structure adjacent the underside of said table, and a link between the leg structure and the underside of said table, said legs being movable between a first working position and a second folded position, movement of said legs towards said storage position operating to move said wheel from a first position near the underside of said table to a second position relatively further outboard of the underside.

8. The improvement of claim 7 wherein its legs are adjustable height wise.

9. A foldable table comprising:

a top;

a pair of beams;

a tubular structure arranged generally perpendicular to said beams;

a pair of wheels mounted to said tubular structure;

a linkage between said tubular structure and said beams, said linkage being attached to said beams at a pivot point;

movement of said tubular structure about said pivot point causing movement of said wheels between at least a first position adjacent said tabletop and a second position remote from said tabletop.

* * * * *